US007824205B2

(12) United States Patent
Scislak

(10) Patent No.: US 7,824,205 B2
(45) Date of Patent: Nov. 2, 2010

(54) PLUG ARRANGEMENT FOR AN ELECTRIC OR OPTICAL CABLE

(75) Inventor: Ireneusz Scislak, Cologne (DE)

(73) Assignee: Eaton Industries GmbH, Bonn (DE)

( * ) Notice: Subject to any disclaimer, the term of this patent is extended or adjusted under 35 U.S.C. 154(b) by 0 days.

(21) Appl. No.: 12/293,406

(22) PCT Filed: Mar. 6, 2007

(86) PCT No.: PCT/EP2007/001883

§ 371 (c)(1),
(2), (4) Date: Jan. 21, 2009

(87) PCT Pub. No.: WO2007/107233

PCT Pub. Date: Sep. 27, 2007

(65) Prior Publication Data

US 2009/0298350 A1 Dec. 3, 2009

(30) Foreign Application Priority Data

Mar. 17, 2006 (DE) ..... 10 2006 012 762

(51) Int. Cl.
*H01R 13/62* (2006.01)

(52) U.S. Cl. ..... 439/344

(58) Field of Classification Search ..... 439/344, 439/352, 418

See application file for complete search history.

(56) References Cited

U.S. PATENT DOCUMENTS 5,462,457 A * 10/1995 Schroepfer et al. ..... 439/736
5,638,474 A 6/1997 Lampert et al.
5,685,736 A * 11/1997 Lung ..... 439/447
6,322,386 B1 * 11/2001 Tharp et al. ..... 439/344
7,101,212 B1 * 9/2006 Larkin ..... 439/344
7,329,137 B2 * 2/2008 Martin et al. ..... 439/344
7,354,291 B2 * 4/2008 Caveney et al. ..... 439/344
7,431,604 B2 * 10/2008 Waters et al. ..... 439/344
7,578,690 B2 * 8/2009 Caveney et al. ..... 439/344
2004/0134061 A1 7/2004 Kuiken et al.
2006/0199414 A1 * 9/2006 Larkin ..... 439/344

FOREIGN PATENT DOCUMENTS

| | | |
|---|---|---|
| DE | 69610961 | 3/2001 |
| DE | 202004019870 | 11/2005 |
| EP | 0637102 | 2/1995 |
| GB | 2038568 | 7/1980 |

* cited by examiner

*Primary Examiner*—Gary F. Paumen
(74) *Attorney, Agent, or Firm*—Leydig, Voit & Mayer, Ltd.

(57) ABSTRACT

A plug arrangement for an electric or optical cable includes a connector body connected with the cable and including a first socket or plug. An insulating housing is provided configured to receive the connector body. A locking tab is articulated at a front edge of the connector body and configured to block release of the connector body from a counter body having a plug-in opening and including a second plug or a socket complementary to the connector body. A length of the locking tab is less than or equal to a depth of the plug-in opening. A resilient actuation element is provided including a pressure body extending parallel to a plug-in direction of the plug arrangement. The actuation element is integrally disposed in an articulated manner via a film hinge on the housing so as to be deformable with the housing and actuate the locking tab. The actuation element is integrated in a wall of the housing via at least one surface element disposed on the housing.

5 Claims, 3 Drawing Sheets

PLUG ARRANGEMENT FOR AN ELECTRIC OR OPTICAL CABLE

CROSS REFERENCE TO PRIOR APPLICATIONS

This application is a U.S. National Phase application under 35 U.S.C. §371 of International Application No. PCT/EP2007/001883, filed Mar. 6, 2007, and claims benefit to German Patent Application No. DE 10 2006 012 762.5, filed Mar. 17, 2006. The International Application was published in German on Sep. 27, 2007 as WO 2007/107233 under PCT Article 21 (2).

FIELD

The invention relates to a plug arrangement for an electric or optical cable.

BACKGROUND

Applications for plug arrangements for an electric or optical cable are generally found in connection technology for optical and/or electronic networks in office technology, including for example Ethernet as a network and plugs of the RJ45 or RJ11 type. Meanwhile, the connection end of a cable of this type which is used for plugs is subject to a high degree of standardisation.

A standardised construction is shown in FIG. 6. The end of a standardised cable 10 with a plug body 110 of the RJ45 or RJ11 type is shown in this case. The plug body is assembled on the end of the cable with mounting technology. On the upper side of the plug body a mechanical locking device is provided, which is to be opened using a manually actuated locking tab 112 when the plug body, which is plugged into a socket, is to be released therefrom. The depressed locking tab releases the plug body, by means of locking hooks 115, from the connection to a counter body (socket) which is complementary to the plug body.

In general, the plug body is enclosed by a housing made of insulating material, parts of the housing also covering the locking device. The housing is intended predominantly to provide protection against contact, and may further include means for fastening the plug body to a connection part, formed for example as a gland nut, with which the cable can be attached to the device in which the complementary counter body is arranged.

Various plug arrangements, with various constructions of the insulating material housing and/or of the actuation elements for the mechanical locking device, are commercially available.

Plug arrangements of this type have some disadvantages as regards the operation of the actuation elements: for example, the fact that said elements are arranged in such a way that they are difficult to access when the plug is plugged in, because they are located very close to the surface of the device. Therefore, the user is sometimes forced to also use a further tool which, in the particular case where a suitable tool is lacking, could even be a toothpick, for example. A further disadvantage can be seen in the fact that the housing of the plug body is not completely closed in the region of the actuation elements. Windows, which conflict with the requirement for secure insulation, are present there. Plug arrangements of this type fail in a test of electric strength and leakage distance.

SUMMARY

In an embodiment, the present invention provides a plug arrangement for an electric or optical cable. The arrangement includes a connector body connected with the cable and including a first socket or plug. An insulating housing is included configured to receive the connector body. A locking tab is articulated at a front edge of the connector body and configured to block release of the connector body from a counter body having a plug-in opening and including a second plug or a socket complementary to the connector body. A length of the locking tab is less than or equal to a depth of the plug-in opening. A resilient actuation element is included, the actuation element including a pressure body extending parallel to a plug-in direction of the plug arrangement. The actuation element is integrally disposed in an articulated manner via a film hinge on the housing so as to be deformable with the housing and actuate the locking tab. The actuation element is integrated in a wall of the housing via at least one surface element disposed on the housing.

BRIEF DESCRIPTION OF THE DRAWINGS

Further features and advantages of the invention will emerge from the following embodiments, explained by means of the figures, in which.

DETAILED DESCRIPTION

An aspect of the present invention provides a plug arrangement in which the actuation for mechanical unlocking is possible in a safe and simple manner, and which has a high electric strength.

The basis of the present invention is that the actuation element consists of a pressure body, which is formed parallel to the plug-in direction and which is connected to the housing by means of at least one surface element formed in the housing, and the actuation element includes a pressure part for manual actuation. The actuation element is distinctive by virtue of a particularly long lever arm.

A construction of this type leads to the further advantage that the manual actuation can be carried out easily without a tool and the arrangement also easily endures high voltage tests because no exposed surfaces of the metallic plug casing are present.

The housing made of insulating material is simple to produce because the shaping can be formed in a casting or injection mould.

The following forms are embodiments according to the present invention:

The at least one surface element forms the outer surface of the insertion shaft for the locking tab.

The at least one surface element is formed in the housing with reduced material wall thickness and held in place in the housing with a film hinge.

The at least one surface element includes an opening. The housing is formed within the opening so as to cover up the connector body.

FIGS. 1 to 5 show a housing for a plug arrangement for an electric or optical cable in accordance with embodiments of the present invention. An arrangement includes a connector body 110 which is constructed as a socket or as a plug.

Generally, the surface of a connector body is constructed from a metal or consists of a metal shell which allows a conductive, potential-free connection between the plug and the socket to be produced.

Figure 5:
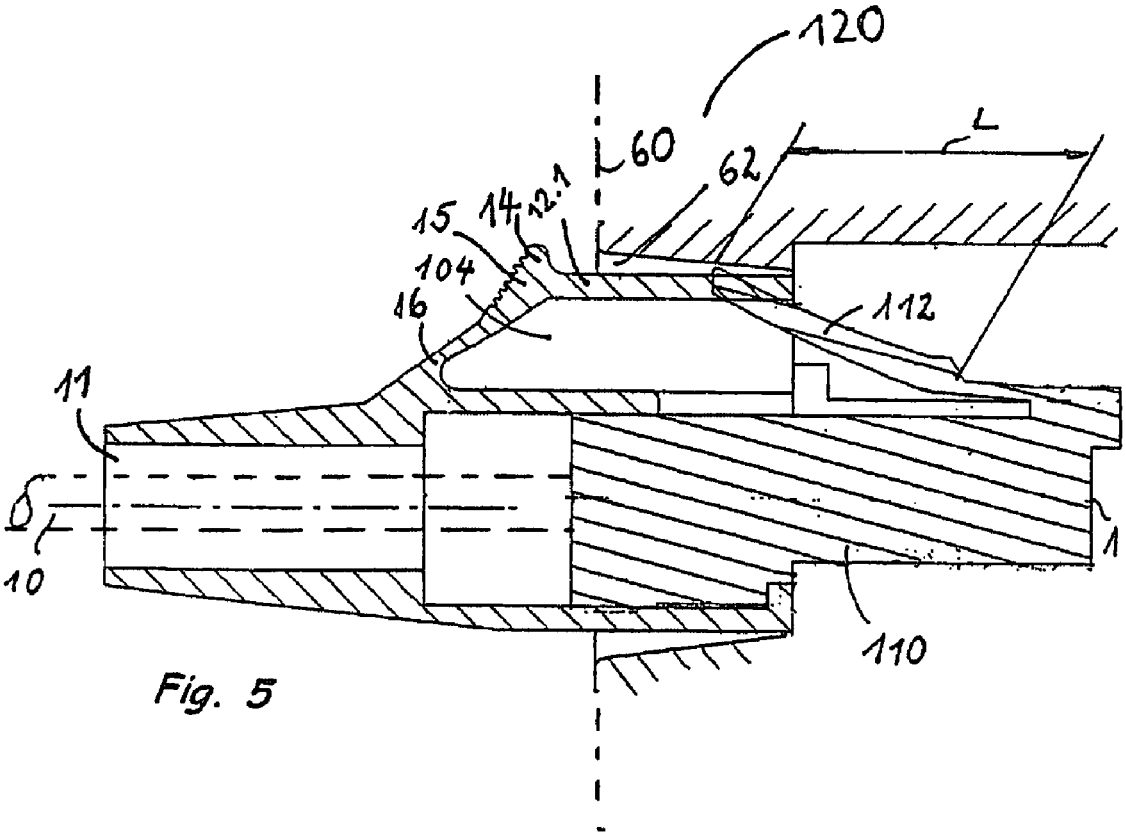
FIG. 5 is a cross-section view of housing with the plug body assembled in accordance with an embodiment of the present invention.
Figure 6:
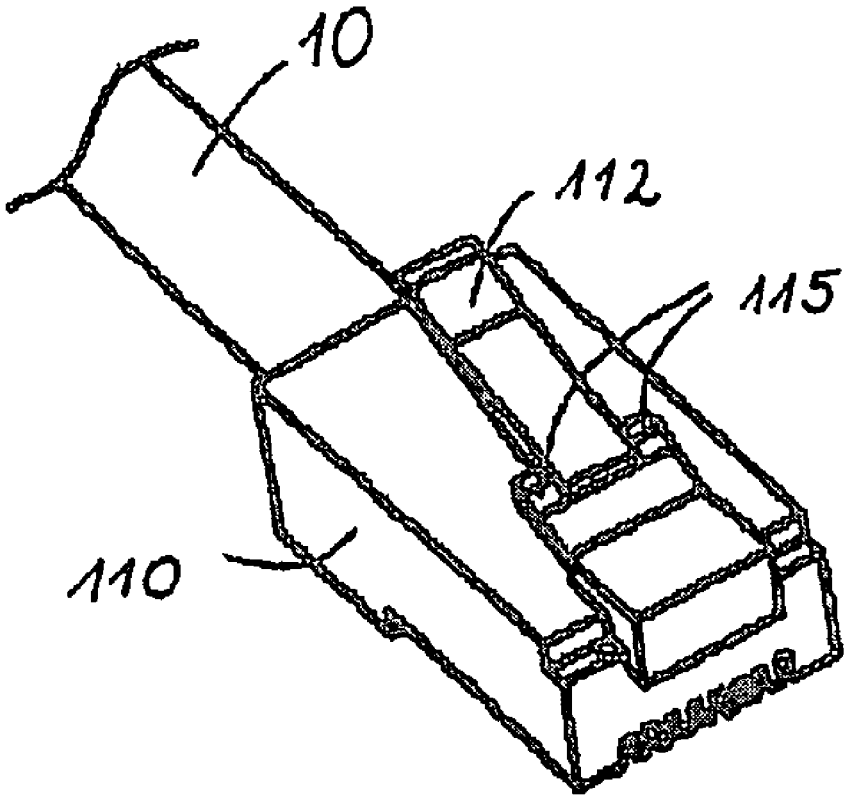
PRIOR ART Fig. 6
FIG. 6 is an illustration of a typical construction of a prior art cable end.

FIG. 5 shows schematically an assembled connector arrangement which is plugged into a device. A "device" should be understood here to mean any type of device, for example a circuit board, a cable channel, a telephone and/or an electronic device. The device edge or device surface 60 and the insertion opening 62 for the plug of the device can be seen. The locking tab 112 is articulated to the front edge 114, for example, of the connector body 110. In FIG. 5 it can also be seen in particular that the length L of the locking tab 112 is no longer than the depth of the plug-in opening 62. The locking tab is shown in the slack position thereof, as it would be positioned if no connector body 110 were plugged in. It can be seen that once the connector body 110 has been plugged in, the locking tab is depressed by the element 12.1, which is yet to be described.

The mechanism for assembling the connector body with a cable are not shown in the figures. The assembly may, for example, take place through crimping, and a socket, for example, may be attached for fastening to a device.

The plug arrangement has a rectangular cross-section in the embodiments shown. However, the arrangement can equally well be constructed for plugs with a round cross-section. The proposed arrangement has a housing 100, consisting of an insulating material, for the connector body 100. The insulating material may be a resilient plastics material. On the front edge 114 of the connector body 110, a locking tab 112 is disposed in an articulated manner and so as to be movable in the direction opposite to the plug-in direction, and acts to block the release of the connector body 110 from a counter body 120, which is formed as a plug or a socket and which is complementary to the connector body 110. The length L of the locking tab is dimensioned in such a way as to be no longer than the depth of the plug-in opening. A resilient actuation element 12 for actuating the locking tab 112 is arranged on the housing 100. The actuation element has a particularly long lever arm, and this substantially facilitates the depression of the locking tab 112.

The element 12 is integral with the housing 100 and constructed so as to be deformable therewith.

The actuation element 12 consists of an articulation point 16, a pressure part 14 (for manual actuation for releasing the mechanical locking device) which is constructed as a handle, and a pressure body 12.1 which is constructed parallel to the plug-in direction.

The aforementioned components of the actuation element 12 are constructed in one piece with the housing and thus, in effect, integrated into the housing wall. The articulation point 16 (as the root of the bridge 15) lies close to the cable insertion opening 11. Between the articulation point 16 and the pressure part 14 which is constructed as a handle, a diagonally rising bridge 15 is present for the finger of a user to be applied to in the unlocking process (see FIG. 2). The bridge 15, handle 14 and pressure body 12.1 are located in a line and form a relatively inflexible unit. The resilience and movability of this unit come about by virtue of the articulation point 16, which is constructed as a film hinge. The movability is supported by the reduction of the material thickness of the surface elements 17 on both sides.

Figure 1:
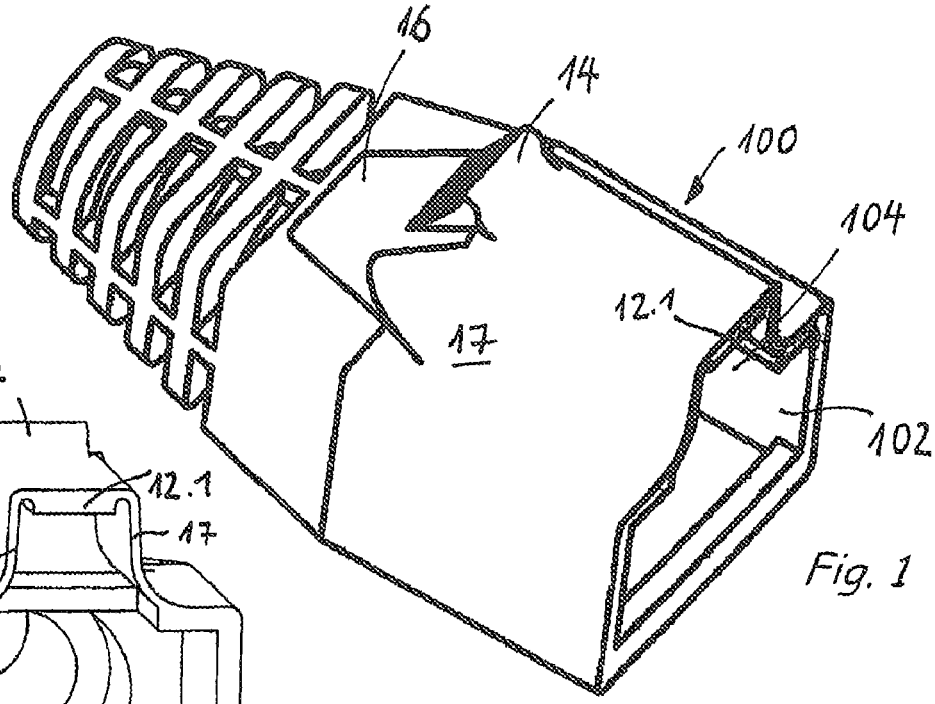
FIG. 1 is a view of a first embodiment of the housing according to the present invention.
Figure 2:
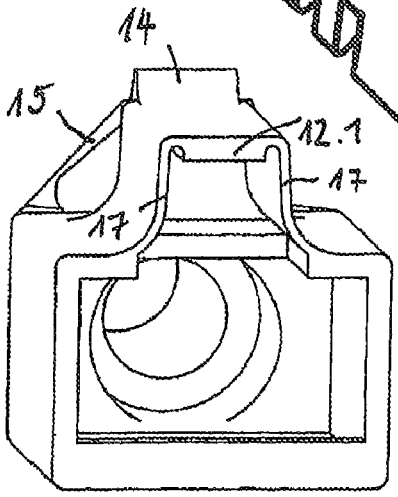
FIGS. 2 and 3 are views of a second embodiment of the housing according to the present invention.
Figure 3:
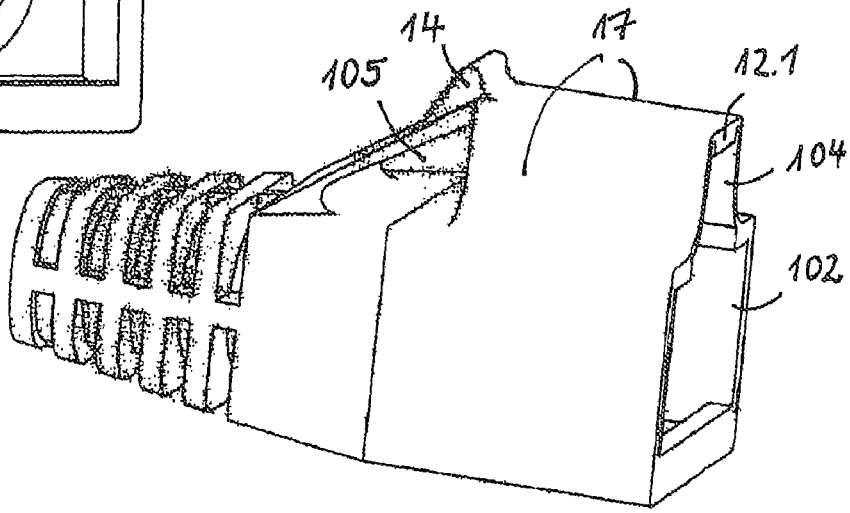
Figure 4:
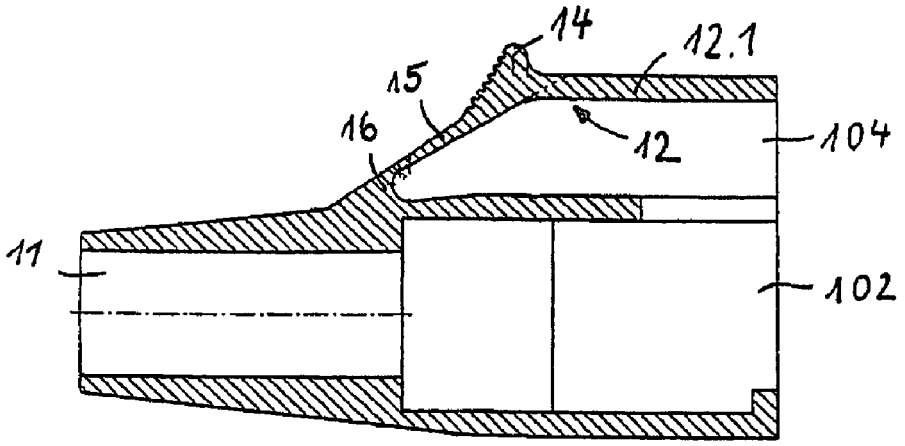
FIG. 4 is a cross-section view of the housing without the plug body in accordance with an embodiment of the present invention.

The two embodiments shown differ in that in FIG. 1, the surface elements 17 on both sides are closed in the housing on all sides, and in FIG. 3, the surface elements 17 include an opening. The two embodiments are not necessarily differ in terms of flexibility, if the stiffness of the material of the housing and the material thickness of the surface elements 17 are constructed differently according to the particular application.

Surface elements 17 are present on both sides of the insertion shaft 104 for the locking tab 112, and form the outer surface thereof. As mentioned previously, the surface element 17 on each side is formed in the housing 100 with reduced material wall thickness.

In the form of the surface element 17 which is not closed on all sides, an opening 105 is present, but the housing 100 is closed in the interior of the opening. The connector body 110 is covered at this location. In this way, the connector arrangement still achieves a highly secure insulation. IP protection requirements are also met, because there is no window through which the surface of the connector body 110 is accessible.

The present invention is not limited to the embodiments disclosed above, but also includes all configurations which are possible within the meaning of the invention. These may vary in the cross-sectional shape of the plug arrangement, i.e. are not limited to plug types such as RJ45 or RJ11. The proposed arrangement may equally well be applied to optical and to electric plugs. Further, the present invention is not limited to the embodiments described herein, and reference should be had to the appended claims.

The invention claimed is:

1. A plug arrangement for an electric or optical cable, comprising:

a connector body connected with the cable and including a first socket or plug;

an insulating housing configured to receive the connector body;

a locking tab articulated at a front edge of the connector body and configured to block release of the connector body from a counter body having a plug-in opening and including a second plug or a socket complementary to the connector body, a length of the locking tab being less than or equal to a depth of the plug-in opening; and a resilient actuation element including a pressure body extending parallel to a plug-in direction of the plug arrangement, the actuation element being integrally disposed in an articulated manner via a film hinge on the housing so as to be deformable with the housing and actuate the locking tab, the actuation element being integrated in a wall of the housing via at least one surface element extending between the pressure body and the wall.

2. The plug arrangement as recited in claim 1, wherein the at least one surface element includes an outer surface of an insertion shaft configured to receive the locking tab.

3. The plug arrangement as recited in claim 1, wherein the at least one surface element has a thickness at the housing wall lower than a thickness of other portions of the at least one surface element.

4. The plug arrangement as recited in claim 2, wherein the at least one surface element has a thickness at the housing wall lower than a thickness of other portions of the at least one surface element.

5. The plug arrangement as recited in claim 1, wherein the at least one surface element includes an opening, and wherein a portion of the housing is disposed within the opening so as to cover a portion of the connector body.

* * * * *